United States Patent [19]

Heinrich

[11] Patent Number: 4,804,461

[45] Date of Patent: Feb. 14, 1989

[54] PROCESS FOR RECOVERING BARITE FROM DRILLING MUDS

[76] Inventor: Gerhard Heinrich, 2605 Woodchester Drive 26, Missisauga, Ontario, Canada, L5K 2E3

[21] Appl. No.: 131,381

[22] Filed: Oct. 22, 1987

[51] Int. Cl.[4] ..... B03D 1/02

[52] U.S. Cl. ..... 209/166; 210/704; 423/170; 252/61

[58] Field of Search ..... 209/166, 167; 252/61; 423/170; 210/704, 705

[56] References Cited

U.S. PATENT DOCUMENTS

| | | | |
|---|---|---|---|
| 2,120,217 | 6/1938 | Harris | 209/166 |
| 2,225,973 | 12/1940 | Brown | 209/166 |
| 2,982,401 | 5/1961 | Talbot | 209/166 |
| 3,122,500 | 2/1964 | Gullett | 209/166 |
| 4,363,724 | 12/1982 | Panzer | 209/166 |
| 4,456,537 | 6/1984 | Oliver | 210/728 |
| 4,515,699 | 5/1985 | Oliver | 210/727 |
| 4,528,102 | 7/1985 | Oliver | 210/705 |

FOREIGN PATENT DOCUMENTS

| | | | |
|---|---|---|---|
| 1189503 | 11/1985 | U.S.S.R. | 209/167 |

OTHER PUBLICATIONS

"Recovery of Barite from Tailings Ponds and By Passed Mine Waste", by Sullivan and Lamont, Min. Eng. (33) 1981 1632–1634.

*Primary Examiner*—David L. Lacey
*Assistant Examiner*—Thomas M. Lithgow

[57] ABSTRACT

At present the usual method of recycling of drilling muds by the exclusive application of classifying processes during drilling rig operation leads to the disposal of fine grained barite containing waste materials. In this invention, a simple one-stage flotation process using alkylphosphate based collecting and foaming reagents is applied to recover the barite content of such muds thus producing a marketable barite concentrate. The flotation should preferably be carried out at pH 8 to 9 with CaO, $Ca(OH)_2$ or KOH as regulating reagents and with the optimal solids content in the flotation pulp (preferably 100 g/l). The solids content in the flotation pulp can easily be adjusted by diluting with process water.

20 Claims, No Drawings

PROCESS FOR RECOVERING BARITE FROM DRILLING MUDS

SUMMARY OF THE INVENTION

This invention relates to a beneficiation process for recovering barite from drilling muds.

At present most of the annual world barite production which amounts 5 to 7 Mio. tons (FACHVEREINIGUNG METALLERZBERGBAU e.V.: Jahresbericht und Statistik; Duesseldorf (1985) p. 12–13) is used for drilling muds. Since this material is only partly recycled by applying classifying processes during drilling rig operation (JONES, G. K.: Barytes and alternative weighting agents in oil-well drilling fluids; Trans. Inst Min. Metall. (Sect. A: Min. industry) 93 (1984) p. A153) it finally renders a fine grained barite containing waste material, which often causes disposal problems. Published calculations have shown that drilling a single oil well with a depth of 5.600 m requires approximately 1.600 tons of barite (DRAWATER, C.: Estimation of barytes consumption during oil-well drilling; Ind. Min. (1984) p. 63–65). Direct flotation with carboxylate or alkylsulphate based collecting and foaming reagents and NaOH and/or sodium silicate as regulating reagents is a common process to recover fine grained barite (SULLIVAN, G. V. a. LAMONT, W. E.: Recovery of Barite from Tailings Ponds and Bypassed Mining Waste; Min. Eng. 33 (1981) p. 1632–1634). However, due to the presence of defoaming reagents and other additives in drilling muds and their normally high salinity barite flotation from these muds with the prementioned reagents is difficult if not impossible. Another problem is caused by the high surface tension and viscosity of the muds which inhibits their dewatering for final disposal by filtering without pretreatment.

The invention is based on a publication of the inventor (HEINRICH, G: Zur Flotierbarkeit sekundärer Barytrohstoffe unter besonderer Berücksichtigung der mineralischen Einflüsse; doctoral thesis at the TU Berlin (1986) p. 84) showing that it is possible to recover barite from drilling muds by a simple flotation process with an alkylphosphate based collecting and foaming reagent. At a pH ranging between 8 and 9 and regulated preferably with CaO (or $Ca(OH)_2$ respectively) and/or KOH it is possible to achieve a barite yield of more than 80% and a marketable barite content of 93 to 95%, if the optimal collector addition (e.g. 3000 g/t Resanol P50) and solid content in pulp (e.g. 100 g/l) are maintained.

The optimization of the process parameters is outlined in the following example:

A sample of drilling muds with a mean grain size $d_{50}=15$ μm and a specific surface of approximately 4.000 $cm^2/g$ was analysed and investigated. In water insoluble substances were barite (64.1%), feldspar, illite, calcite and anhydrite. If dissolved compounds are added, the content of halite in the dried sample is 50%. Furthermore there were traces of pH-stabilisators, dispersants and the defoaming reagent isotributylphosphate present.

The flotation studies were carried out batchwise in a mechanical flotation cell of 1 l in volume. Constant parameters were:

| | |
|---|---|
| dispersion time = | 3 min |
| pH regulation time = | 5 min |

-continued

| | |
|---|---|
| collector conditioning time = | 5 min |
| flotation time = | 10 min |
| stirrer velocity = | 2000 $min^{-1}$ |
| air throughput = | 3.2 l/min |

The tests were carried out after diluting the feed with water and with different collecting reagents, pH values, pH regulating reagents and solids contents of the flotation pulp. Without diluting the feed neither flotation nor filtering of the sample was possible. The test results are evaluated by the barite yield $R_c$ and the barite content $C_c$ in the concentrate as well as by the Concentration Efficiency $C_r$ (STEVENS, J. R. a. COLLINS, D. N.: Technical Efficiency of Concentration Operations; Trans. AIME 220 (1961) p. 697–704), in this case defined as:

$$C_r=R_c\times((C_c-C_a)/(100-C_a))$$

with $C_a$=barite content in the feed (%)

Preliminary studies showed, that compared with sulphosuccinamates, alkylsulphates, fatty acids and carboxylates only alkylphosphate based reagents proved to be adequate collectors. This finding is surprising since the defoaming reagent present belongs also to the group of alkylphosphates. As clearly set foth by the above example the process of the invention requires no preliminary dewatering or washing steps prior to the floation step.

TABLE 1

Concentration Efficiency (Cr), barite yield (Rc) and barite content in concentrate (Cc) related to collector addition in drilling mud flotation with Resanol P50 and Ke 1410 as collectors (pH 9.5 with CaO).

| Collector Type | Collector Addition (g/t) | Cr | Rc (%) | Cc (%) |
|---|---|---|---|---|
| Resanol P50 | 1000 | 0 | 0 | 0 |
| Resanol P50 | 2000 | .55 | 63.9 | 95 |
| Resanol P50 | 2500 | .603 | 78.4 | 91.7 |
| repeat: | | | | |
| Resanol P50 | 2000 | .55 | 63.9 | 95 |
| Ke 1410 | 1000 | .031 | 3.3 | 97.3 |
| Ke 1410 | 1500 | .444 | 66.7 | 88 |
| Ke 1410 | 2000 | .364 | 89.4 | 78.7 |

Table 1 shows a comparison of the two most effective alkylphosphate based collecting reagents, which are Resanol P50 and Ke 1410. While the optimal addition of Ke 1410 is relatively low (1500 g/t) its selectivity is much lower than that of Resanol P50 (optimum 3000 g/t) which contains just 50% alkylphosphate. Using CaO as pH regulating reagent (pH 9.5) the optimal result with Resanol P50 is a barite yield of 83% and a barite content of 91% in the concentrate according to a Concentration Efficiency $C_r$=0.62.

TABLE 2

Influence of pH values on the Concentration Efficiency (Cr), barite yield (Rc) and barite content in concentrate (Cc) in drilling mud flotation with 3000 g/t Resanol P5O (pH regulator KOH).

| pH value | Cr | Rc (%) | Cc (%) |
|---|---|---|---|
| 3 | 0 | 0 | 0 |
| 5 | .479 | 54.3 | 95.8 |
| 7 | .702 | 82.1 | 94.8 |
| 9 | .792 | 92.6 | 94.8 |
| 11 | .283 | 93 | 75 |

The influence of pH value can be seen from Table 2. In this test serie KOH was used to adjust the pH value in the flotation pulp while the solids content was the same as for Table 1. The maximal Concentration Efficiency is achieved for a pH around 8 to 9. It is also apparent that KOH as pH regulator yields slightly better flotation results than CaO (compare Tables 1 and 2). However, since the consumption of pH regulating reagents is high (several kg/t), the use of KOH will not be economical in this case. The successful use of CaO (or the resulting calcium hydroxide) as pH regulator as well as the fact that the pH value should not exceed pH 9 are both unexpected results. Normally, it can be expected that calcium ions precipitate and inactivate anionic collectors—such as alkylphosphates. For typical barite flotation applications pH values higher than 9 are common and deleterious effects of pH values above 9 are not known.

TABLE 3

Concentration Efficiency (Cr), barite yield (Rc) and barite content in concentrate (Cc) in relation to the solids content of the pulp in drilling mud flotation with 2000 g/t Resanol P50 (pH 9 with CaO).

| solids content (g/l) | Cr | Rc (%) | Cc (%) |
|---|---|---|---|
| 25 | .157 | 16.7 | 97.9 |
| 50 | .433 | 53.1 | 93.4 |
| 100 | .517 | 61.8 | 94.1 |
| 200 | .345 | 55.6 | 86.4 |
| 500 | .004 | 40.6 | 64.4 |

As shown in Table 3, the influence of the solids content of the flotation pulp is significant. It is related on one hand to the dilution of water soluble disturbing materials in the feed and on the other hand to pulp rheology and froth behaviour if collector addition and pH value are kept constant. For the investigated sample and optimal solids content was found to be in the range around 100 g/l.

The embodiments of the invention in which an exclusive property or privilege is claimed are defined as follows:

1. A froth flotation process to recover barite from drilling muds, which are normally not amenable to barite flotation and differ from barite ores by contents of antifoaming reagents and other additives, by direct flotation without prior dewatering and washing of the drilling muds, said process comprising:

(a) subjecting drilling mud containing barite in the form of a feed pulp to froth flotation in the presence of an alkylphosphate collecting and frothing reagent in an amount effective to concentrate said barite in the froth; and (b) recovering barite from the froth.

2. A flotation process as claimed in claim 1, in which the pH value of the pulp is adjusted to an optimal value of between 8 and 9.

3. A flotation process as claimed in claim 1, in which calcium oxide or calcium hydroxide are used as pH-regulating reagents.

4. A flotation process as claimed in claim 1, in which potassium hydroxide is used as a pH regulating reagent.

5. A flotation process as claimed in claim 1, in which the solids content in the feed pulp is adjusted by diluting with water.

6. A flotation process as claimed in claim 1, in which the solids content in the feed pulp is between 50 and 200 g/l.

7. A flotation process as claimed in claim 1 in which the amount of the barite collecting and frothing reaent is present during floation in a range from 1500 to 3000 g per metric ton of solids in the said drilling muds.

8. A flotation process as claimed in claim 3, in which the pH value of the pulp is adjusted to an optimum value of between pH 8 and 9.

9. A flotation process as claimed in claim 3, in which the solids content in the feed pulp is adjusted by diluting with water.

10. A flotation process as claimed in claim 3, in which the solids content in the feed pulp is between 50 and 200 g/l.

11. A flotation process as claimed in claim 3, in which the amount of the barite collecting and frothing reagent is present during flotation in a range from 1500 to 3000 g per metric ton of solids in the said drilling muds.

12. A flotation process as claimed in claim 5, in which the pH value of the pulp is adjusted to an optimum value of between pH 8 and 9.

13. A flotation process as claimed in claim 5, in which potassium hydroxide is used as a pH regulating reagent.

14. A flotation process as claimed in claim 5, in which the amount of the barite collecting and frothing reagent is present during flotation in a range from 1500 to 3000 g per metric ton of solids in the said drilling muds.

15. A flotation process as claimed in claim 5, in which the solids content in the feed pulp is between 50 and 200 g/l.

16. A flotation process as claimed in claim 4, in which the pH value of the pulp is adjusted to an optimal value of between pH 8 and 9.

17. A flotation process as claimed in claim 4, in which the amount of the barite collecting and frothing reagent is ranging present during flotation in a range from 1500 to 3000 g per metric ton of solids in the said drilling muds.

18. A flotation process as claimed in claim 4, in which the solids content in the feed pulp is between 50 and 200 g/l.

19. A flotation process as claimed in claim 2, in which the amount of the barite collecting and frothing reagent is present during flotation in a range from 1500 to 3000 g per metric ton of solids in the said drilling muds.

20. A flotation process as claimed in claim 2, in which the solids content in the feed pulp is between 50 and 200 g/l.

* * * * *